US010731854B2

(12) United States Patent
Shen

(10) Patent No.: US 10,731,854 B2
(45) Date of Patent: Aug. 4, 2020

(54) BLOW TORCH WITH SAFETY CONTROL DEVICE

(71) Applicant: Pro-Iroda Industries, Inc., Taichung (TW)

(72) Inventor: Jian-Jhang Shen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 342 days.

(21) Appl. No.: 15/852,053

(22) Filed: Dec. 22, 2017

(65) Prior Publication Data

US 2019/0093890 A1 Mar. 28, 2019

(30) Foreign Application Priority Data

Sep. 25, 2017 (TW) ..... 106132831 A

(51) Int. Cl.
*F23D 14/38* (2006.01)
*F23Q 7/24* (2006.01)
*F23Q 7/06* (2006.01)

(52) U.S. Cl.
CPC ..... *F23Q 7/24* (2013.01); *F23D 14/38* (2013.01); *F23D 2207/00* (2013.01); *F23Q 7/06* (2013.01)

(58) Field of Classification Search
CPC ..... F23Q 7/24; F23Q 7/26; F23D 14/72
USPC ..... 219/263
See application file for complete search history.

(56) References Cited

U.S. PATENT DOCUMENTS 6,293,782 B1 * 9/2001 Tsai ..... F23D 14/28 431/153

FOREIGN PATENT DOCUMENTS

TW M319379 U 9/2007

* cited by examiner

*Primary Examiner* — Janie M Loeppke
(74) *Attorney, Agent, or Firm* — Alan D. Kamrath; Karin L. Williams; Mayer & Williams PC

(57) ABSTRACT

A blow torch includes a casing, an igniter received within the interior, and a safety control device for preventing the actuator being operated from an unactuated position to an actuated position movably coupled to the casing and connected to the igniter. The safety control device includes an actuator movably coupled to the casing, a release movably coupled to the actuator, a first biasing member positioned between the actuator and the release, a retainer movably coupled to the actuator, and a second biasing member positioned between the actuator and the retainer.

13 Claims, 11 Drawing Sheets

BLOW TORCH WITH SAFETY CONTROL DEVICE

BACKGROUND OF THE INVENTION

1. Field of the Invention

The present invention relates to a blow torch and, particularly, to a blow torch with a safety control device.

2. Description of the Related Art

TW Pat. No. M319379 shows a blow torch with a safety device. The safety device prevents the blow torch being activated inadvertently. The blow torch has a casing and the safety device is received by the compartment. The safety device is selectively blocked by a block. The block is fixedly mounted in the compartment. The safety device includes a switch movably retained in the compartment. The switch is releasably engaged with the block. The switch can be moved in a first direction to disengage from the block. When the switch disengages from the block, it can then be moved in a second direction to start ignition. The second direction is angled with respect to the first direction. In order to disengage the switch form the block, the switch is continually forced.

Although the blow torch has a safety device, it is still desirable to provide a safety device that can be operated easily.

The present invention is, therefore, intended to obviate or at least alleviate the problems encountered in the prior art.

SUMMARY OF THE INVENTION

According to the present invention, a blow torch includes a casing having an interior with a first block surface, an igniter received within the interior, and a safety control device movably coupled to the casing and connected to the igniter. The safety control device includes an actuator movably coupled to the casing, a release movably coupled to the actuator, a first biasing member positioned between the actuator and the release, a retainer movably coupled to the actuator, and a second biasing member positioned between the actuator and the retainer.

The actuator is operably movable from an unactuated position to an actuated position. The release is operably movable from a retaining position for retaining the actuator in the unactuated position to a released position such that the actuator is adapted to be operably moved from the unactuated position to the actuated position. The release has a first stop tab and a second stop tab protruding from the first stop tab. The release is urged by the first biasing member. The retainer has a retaining wall. The retainer is positioned in a first position when the release is in the retaining position and is shifted to a second position when the release is operably moved from the retaining position to the released position. The retainer is urged by the second biasing member.

When the release is in the retaining position, a surface of the first stop tab where the second stop tab protrudes is disengaged from the retaining wall and the second stop tab is positioned at a first distance from the retainer and retained on the first block surface.

When the release is in the released position, the surface of the first stop tab is retained on the retaining wall and the second stop tab is positioned at a second distance, which is smaller than the first distance, from the retainer and is disengaged from the first block surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
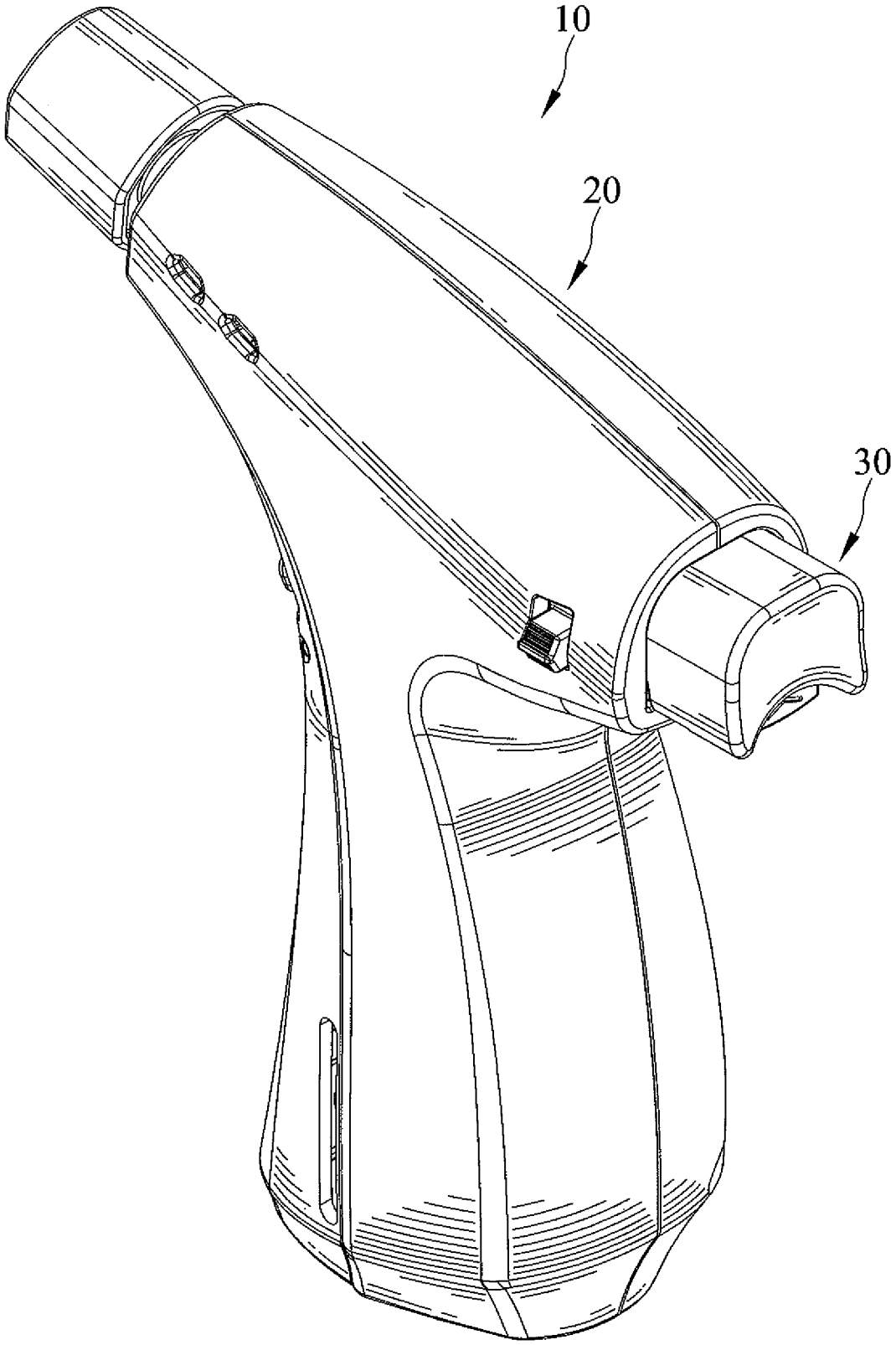
FIG. 1 is a perspective view of a blow torch with a safety control device in accordance with the present invention.
Figure 2:
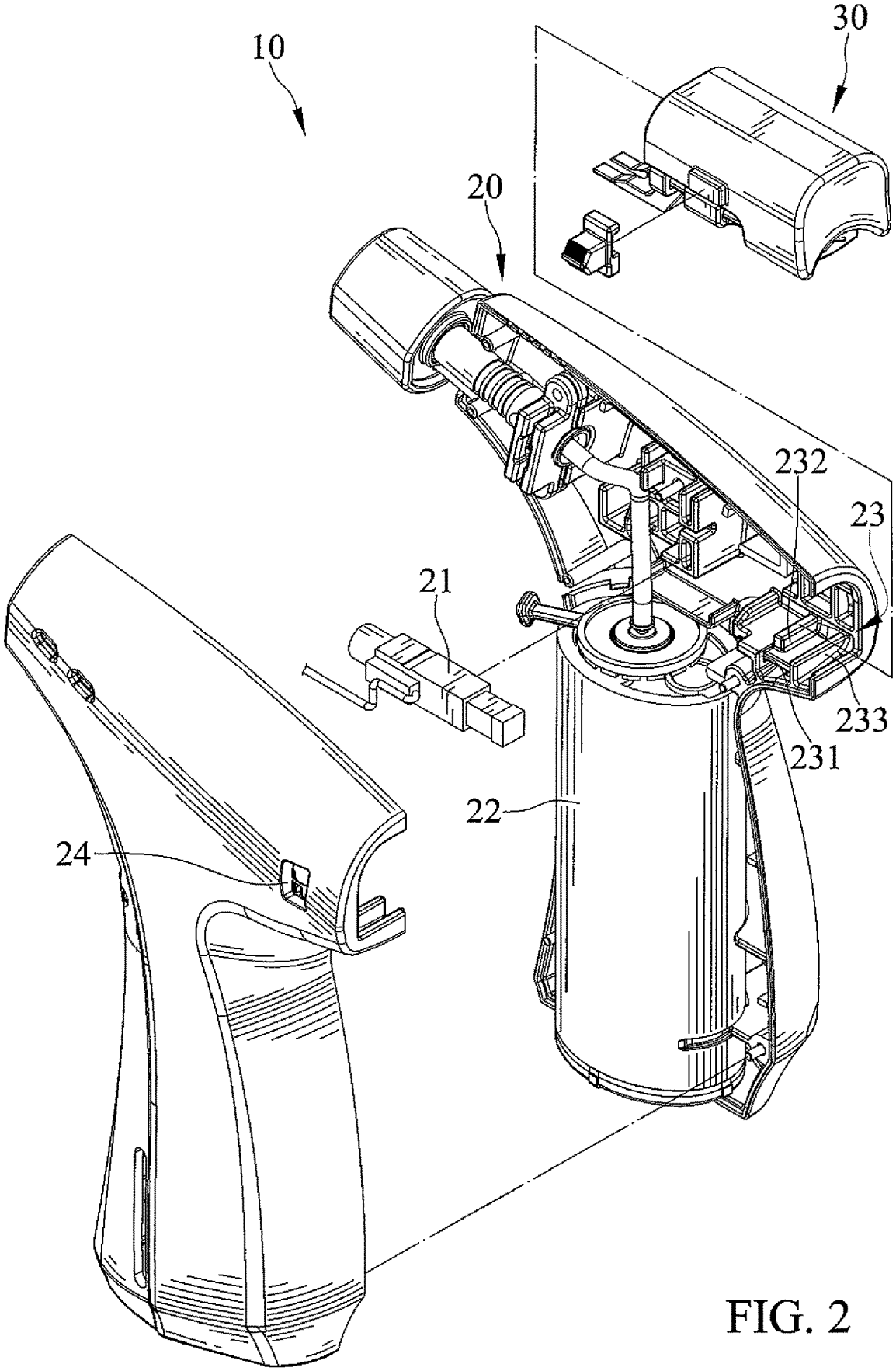
FIG. 2 is an exploded perspective view of the blow torch shown in FIG. 1.
Figure 3:
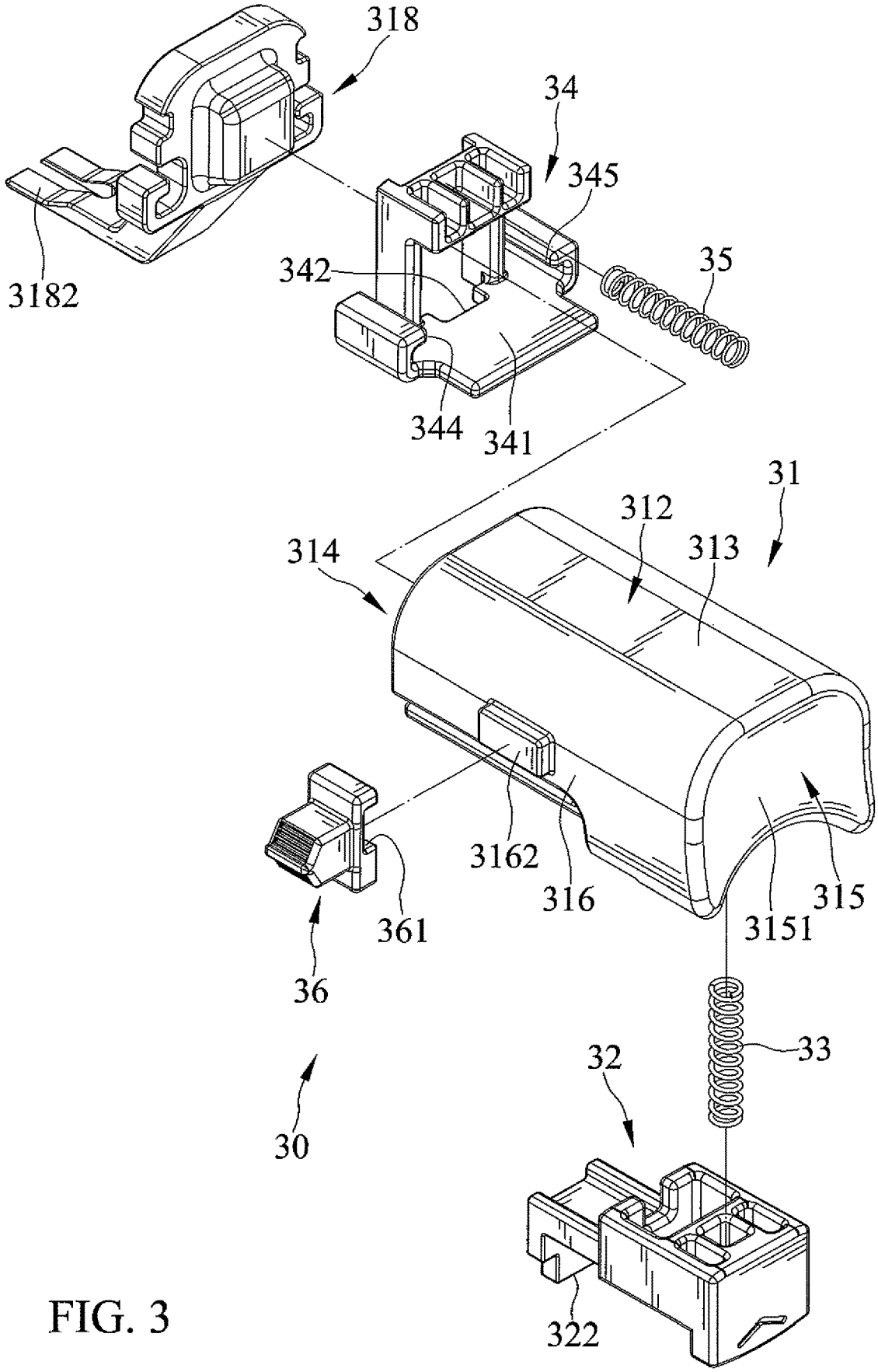
FIG. 3 is a partial, exploded perspective view of the safety control device of the blow torch shown in FIG. 1.
Figure 4:
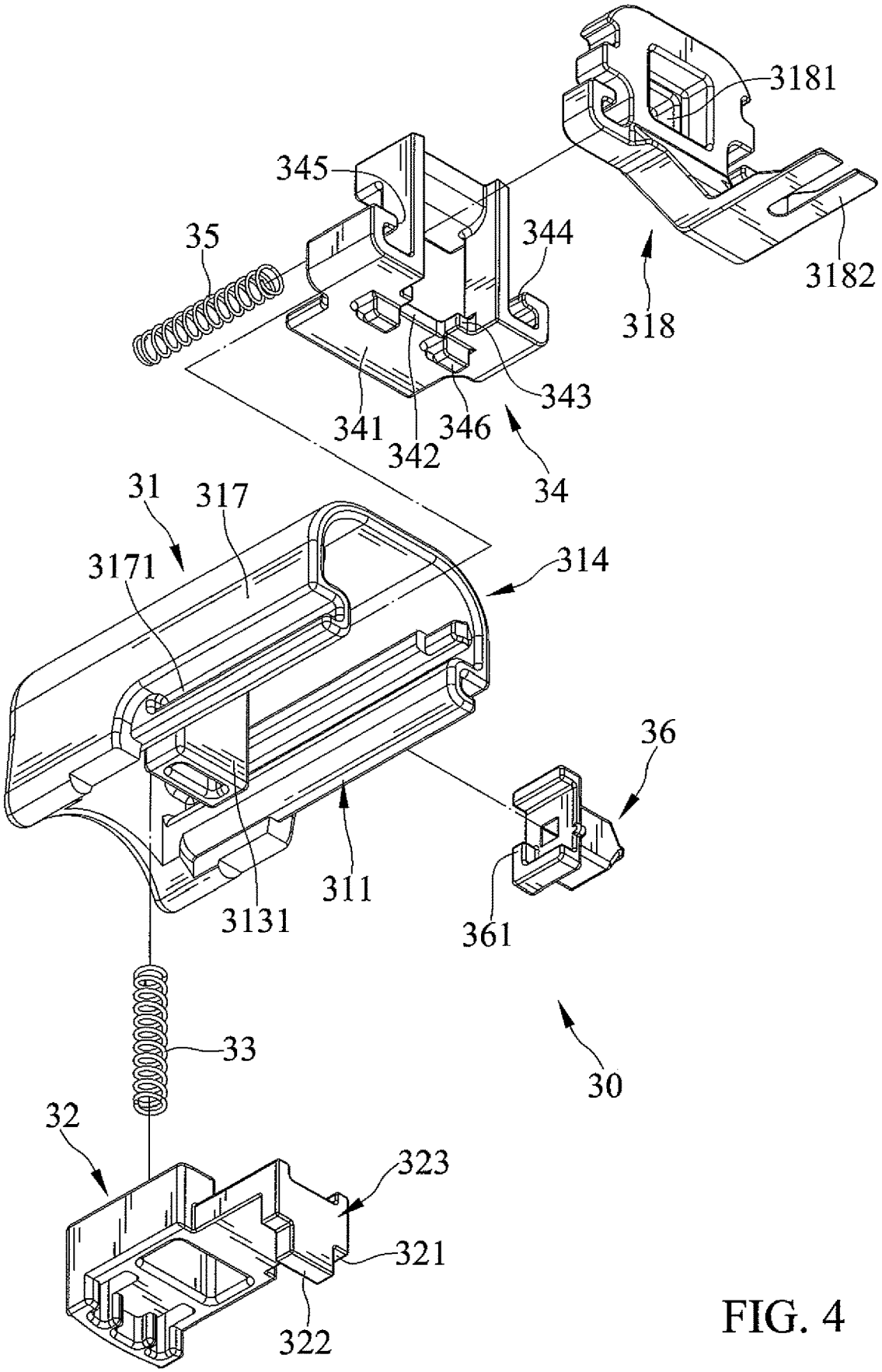
FIG. 4 is a partial, exploded perspective view of the safety control device of the blow torch shown in FIG. 1 viewed from a different angle than that shown in FIG. 3.
Figure 5:
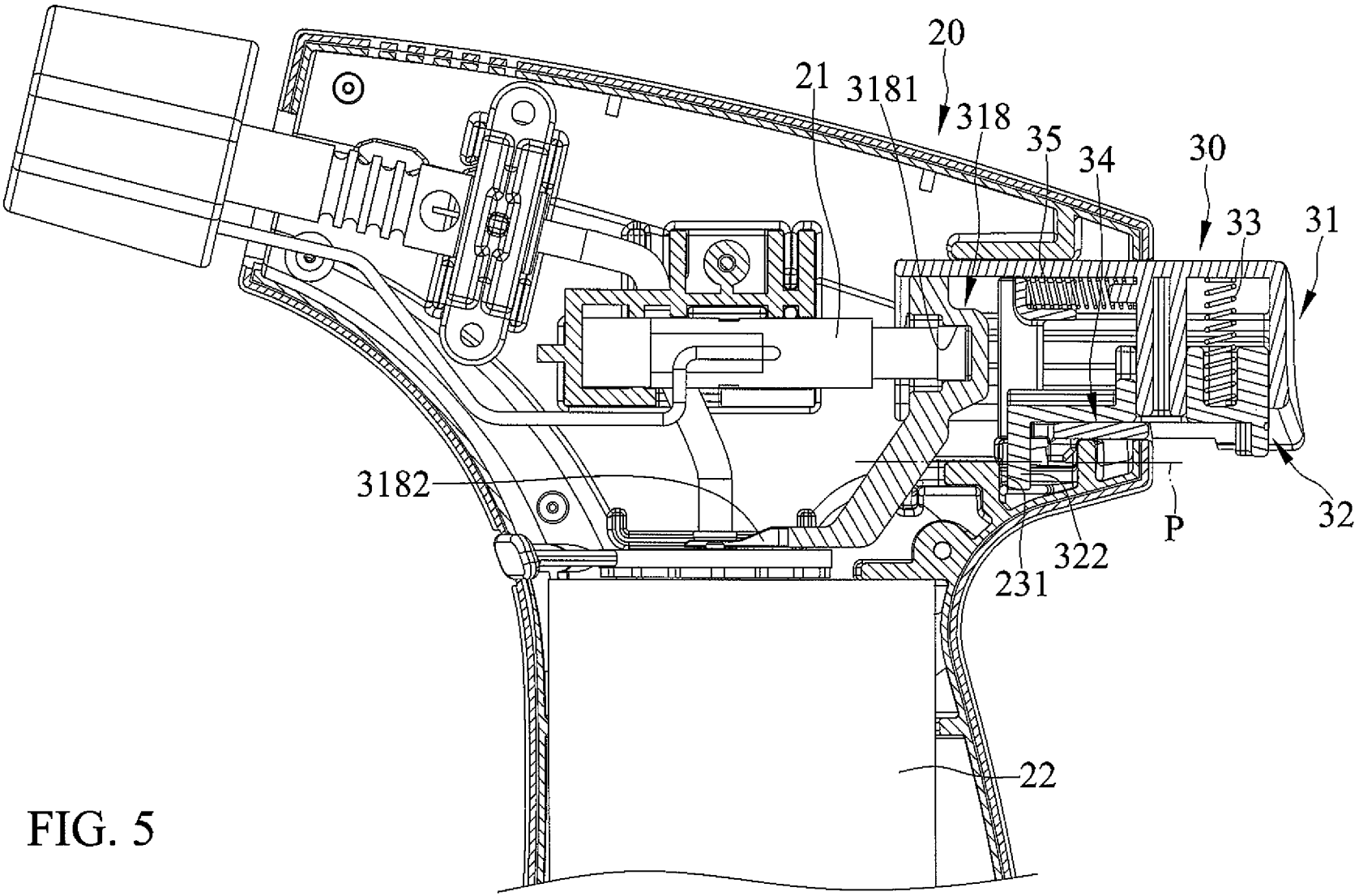
FIG. 5 is a cross-sectional view of the blow torch shown in FIG. 1.
Figure 6:
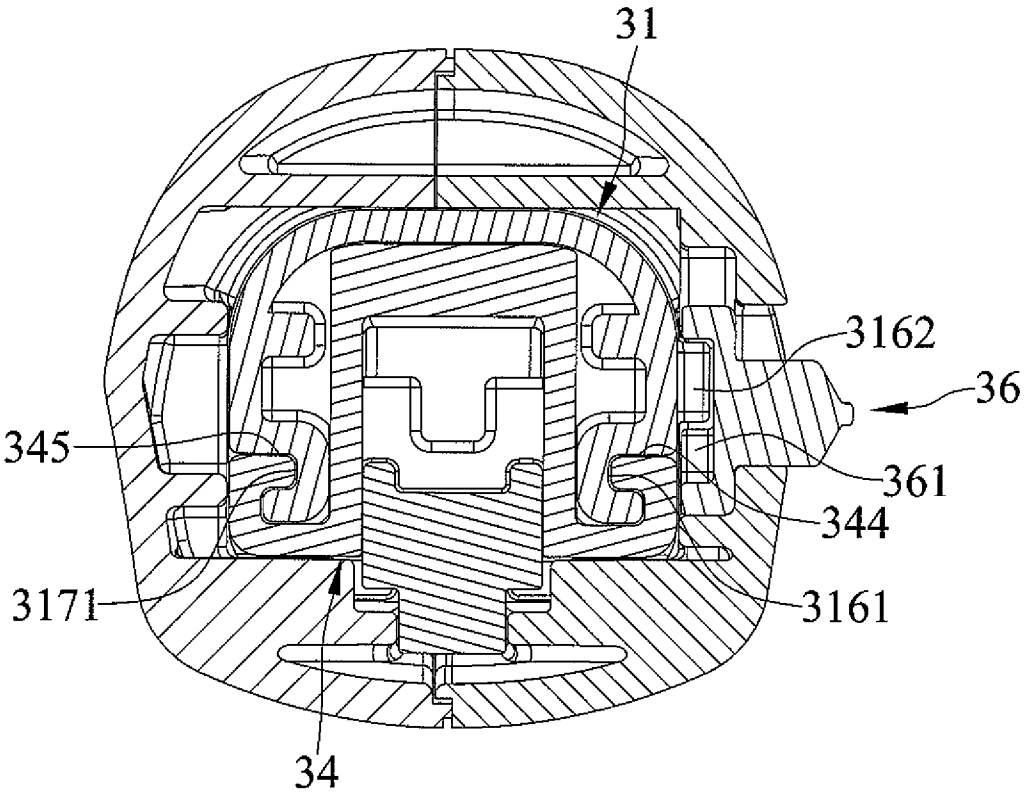
FIG. 6 is another cross-sectional view of the blow torch shown in FIG. 1.
Figure 7:
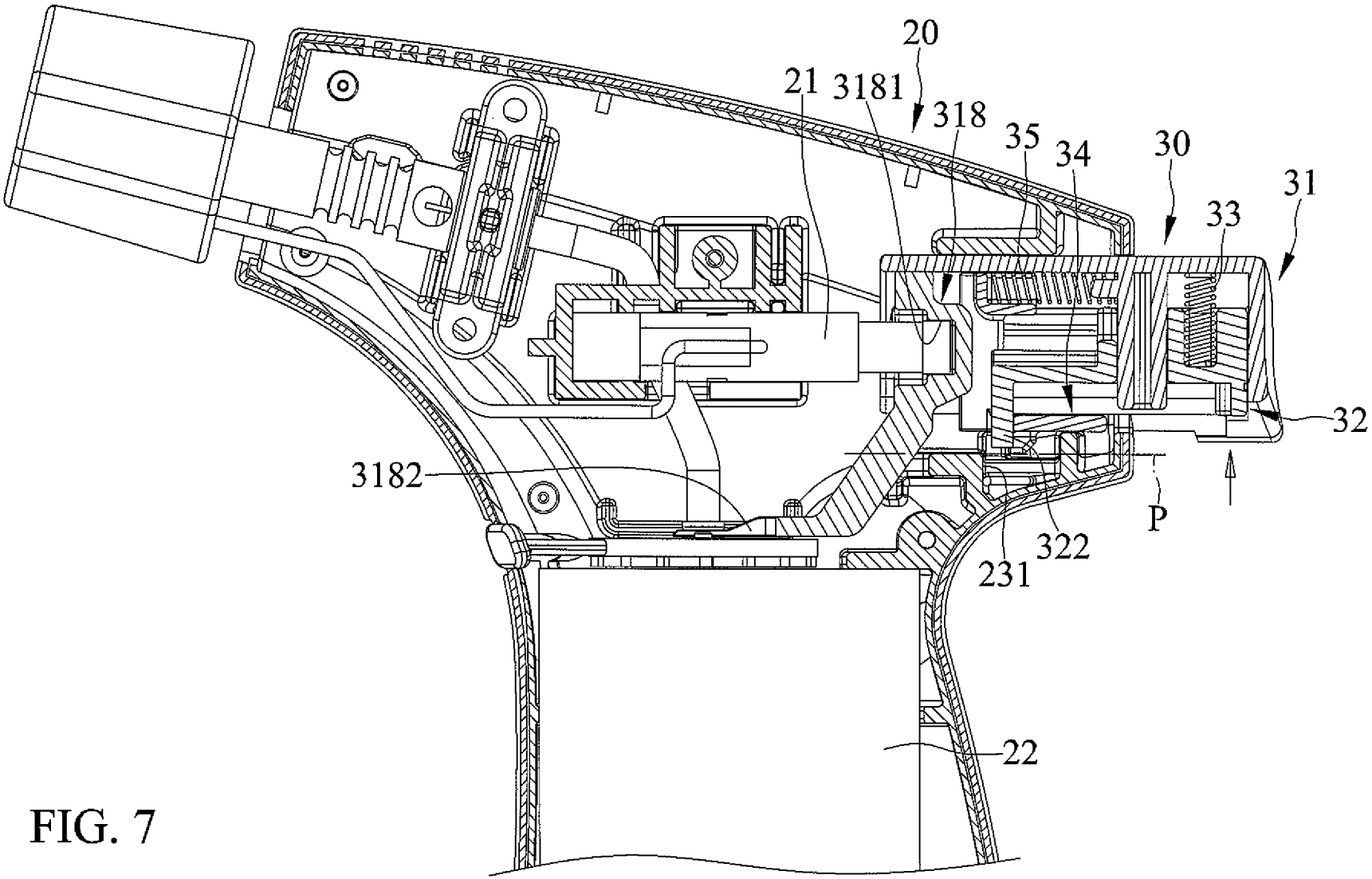
FIG. 7 is a cross-sectional view showing a release of the safety control device in a released position.
Figure 8:
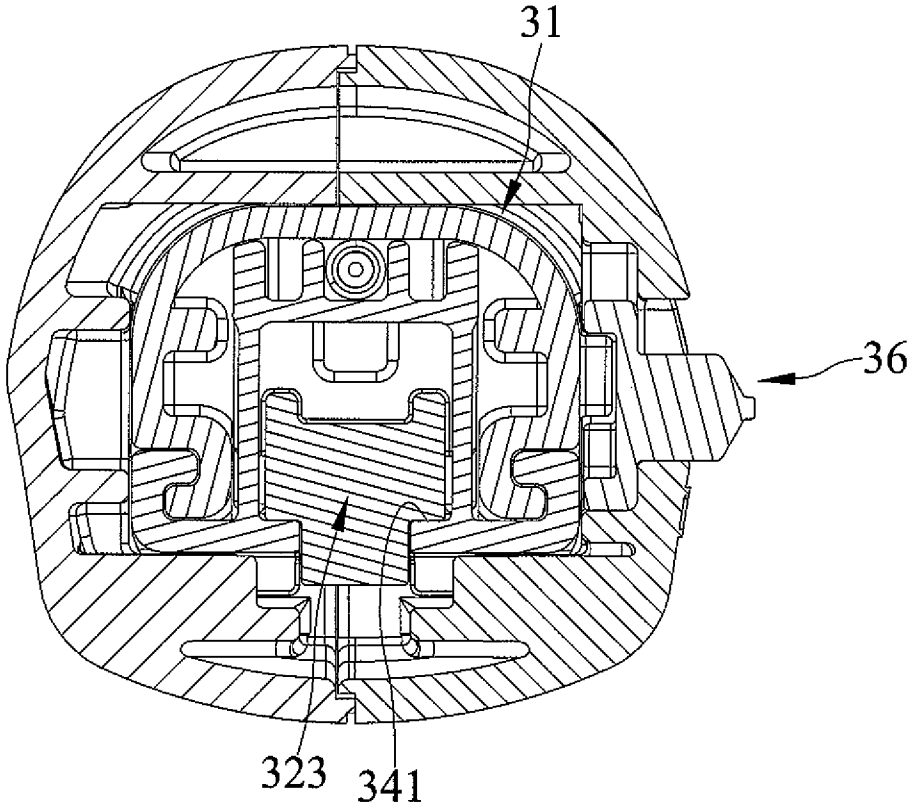
FIG. 8 is another cross-sectional view showing the release in the released position.
Figure 9:
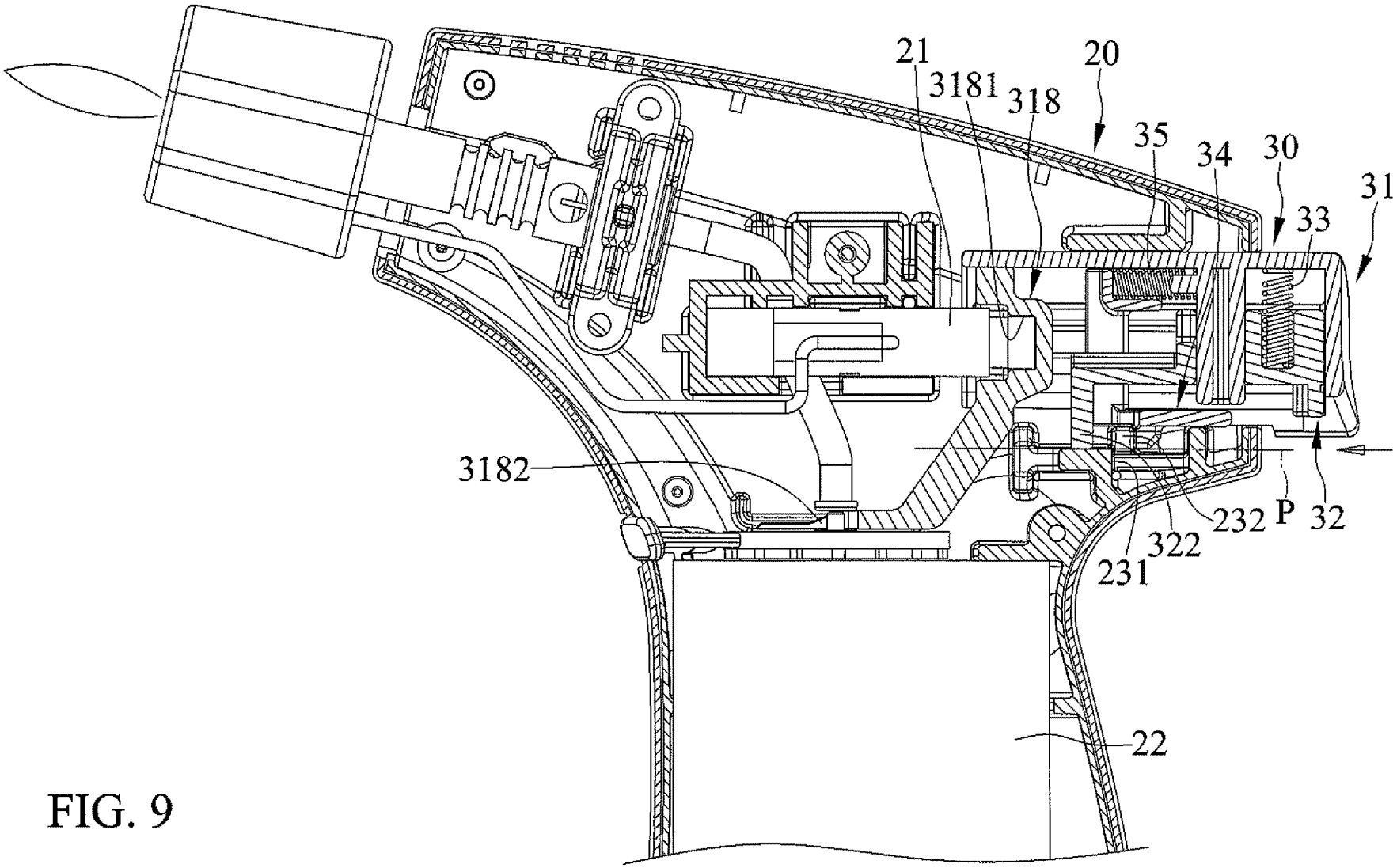
FIG. 9 is a cross-sectional view showing the safety control device in a position actuating an igniter of the blow torch shown in FIG. 1.
Figure 10:
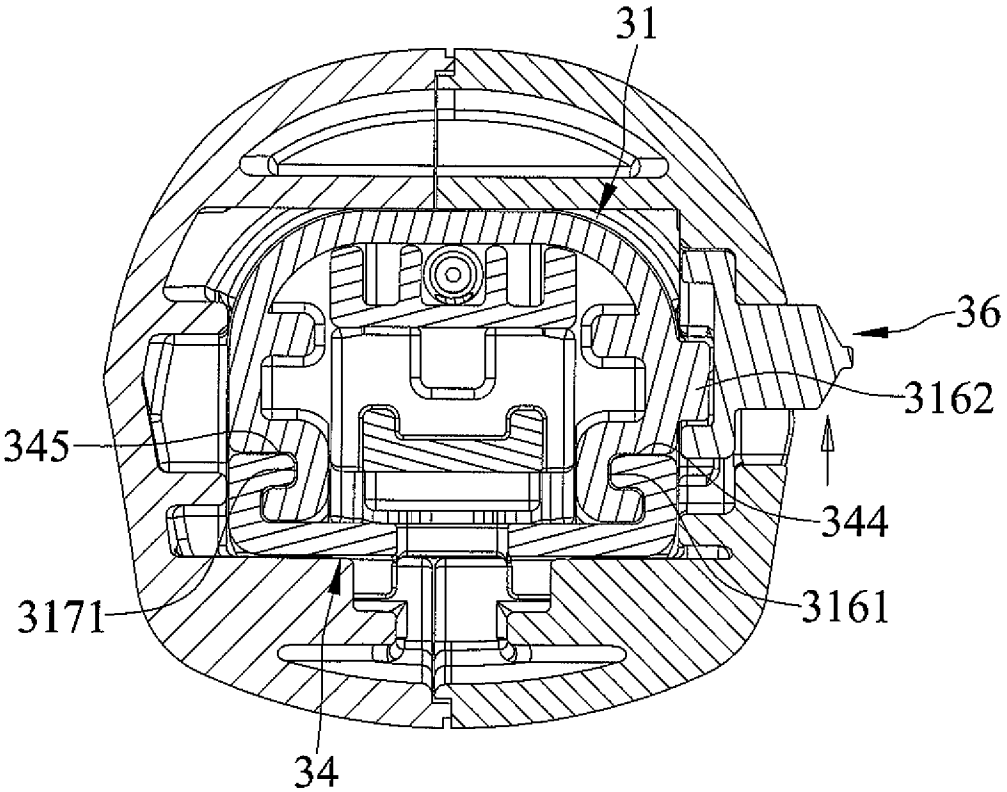
FIG. 10 is a cross-sectional view showing a lock of the blow torch shown in FIG. 1 in a locked position and the safety control device in the position shown in FIG. 8.
Figure 11:
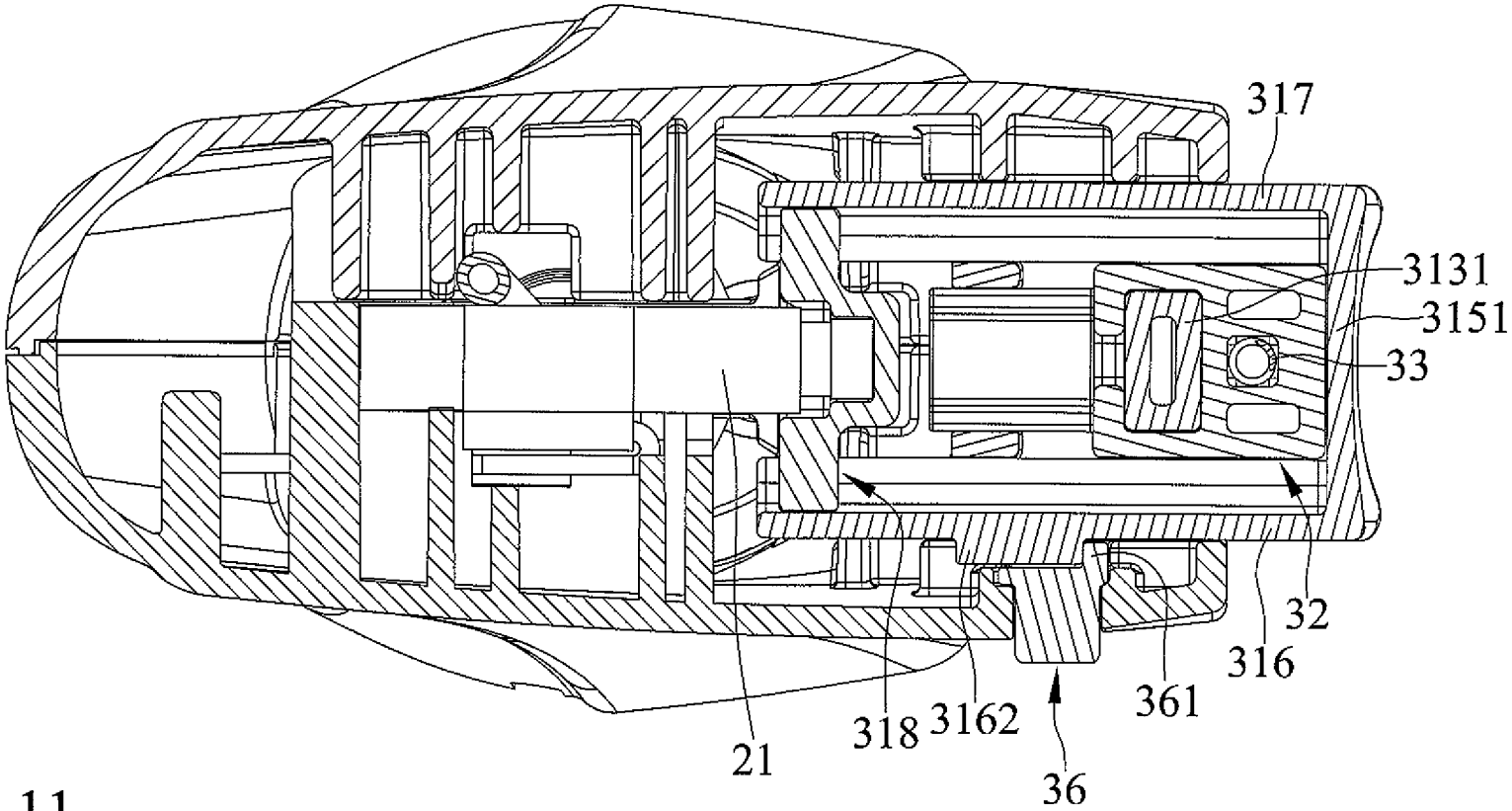
FIG. 11 is another cross-sectional view showing the lock and the safety control device in the position shown in FIG. 8.

FIGS. 1 through 11 show a blow torch 10 in accordance with the present invention. The blow torch 10 includes a casing 20 having an interior, an igniter 21 received within the interior, and a safety control device 30 movably coupled to the casing 20 and connected to the igniter 21. The igniter 21 is fluidly connected to a fuel container 22.

The interior of the casing 20 has a first block surface 231, a second block surface 232, and a third block surface 233. The first block surface 231 extends on a plane P. The interior of the casing 20 includes a first channel 23 and the safety control device 30 is movably positioned in the first channel 23.

The safety control device 30 includes an actuator 31. The actuator 31 is movably coupled to the casing 20. The actuator 31 is operably movable from an unactuated position to an actuated position. The actuator 31 has opposite first and second sides and has a first lug 3161 extending from a first side and a second lug 3171 extending from a second side respectively. The actuator 31 has an inner side 311, an outer side 312, a first peripheral wall 313, second and third peripheral walls 316, 317 extend laterally on opposite sides of the first peripheral wall 313. The first, second, and third peripheral walls 313, 316, and 317 extend from a first end 314 to a second end 315 of the actuator 31. The actuator 31 also has an end wall 3151 at the second end 315 thereof adapted to serve as a user interface to the actuator 31. The end wall 3151 is positioned outside the casing 20. The actuator 31 includes a guide track 3131.

A release 32 is movably coupled to the actuator 31. The release 32 is movably coupled to the guide track 3131 such that the release 32 moves on the guide track 3131 when it changes between the retaining and the released positions. The release 32 has a hole. The guide track 3131 is insertable through the hole of the release 32. The release 32 is movably coupled to the guide track 3131. The release 32 is operably movable from a retaining position for retaining the actuator 31 in the unactuated position to a released position such that the actuator 31 is adapted to be operably moved from the unactuated position to the actuated position. The release 32 has a stop tab 323 and the stop tab 323 includes a first stop tab 321 and a second stop tab 322. The second stop tab 322 protrudes from the first stop tab 321. The first and second stop tabs 321 and 322 have different widths. The second stop tab 322 has a smaller width than the first stop tab 321.

A first biasing member 33 is positioned between the actuator 31 and the release 32. The release 32 is urged by the first biasing member 33.

A retainer 34 is movably coupled to the actuator 31. The retainer 34 has opposite first and second sides and has a third lug 344 extending from the first side and a fourth lug 345 extending from the second side respectively. The first lug 3161 is movably coupled to the third lug 344 and the second lug 3171 is movably coupled to the fourth lug 345 respectively. The retainer 34 has a retaining wall 341. The retainer 34 is positioned in a first position when the release 32 is in the retaining position and is shifted to a second position when the release 32 is operably moved from the retaining position to the released position. The retaining wall 341 has a cavity 342 for retaining the second stop tab 322. The retainer 34 has another retaining wall 343 for retaining the first stop tab 321. Another retaining wall 343 is contiguous to the retaining wall 341. The retainer 34 has a third stop tab 346 and the second block surface 232 is used for retaining the third stop tab 346. The retainer 34 has a through hole and the release 32 extends through the through hole. The cavity 342 is contiguous with the through hole.

A second biasing member 35 is positioned between the actuator 31 and the retainer 34. The retainer 34 is urged by the second biasing member 35. The movement of actuator 31 biases the second biasing member 35, and the retainer 34 is urged by the second biasing member 35.

When the actuator 31 is in the unactuated position, the retainer 34 is disengaged from the second block surface 232. When the actuator 31 is moved to a position between the unactuated position and the actuated position, the third stop tab 346 is retained on the second block surface 232. When the third stop tab 346 is retained on the second block surface 232, the release 32 can be urged by the first biasing member 33 from the released position to the retaining position if the actuator 31 is further moved toward the actuated position.

When the release 32 is in the retaining position, a surface of the first stop tab 321 where the second stop tab 322 protrudes is disengaged from the retaining wall 341 and the second stop tab 322 is positioned at a first distance from the retainer 34 and retained on the first block surface 211.

When the release 32 is in the retaining position, the second stop tab 322 protrudes across the plane P. However, when the release 32 is in the released position, the second stop tab 322 does not protrude across the plane P.

Further, when the release 32 is in the retaining position, the first stop tab 321 has a back surface retained on another retaining wall 343 when the release 32 is in the retaining position. The back surface is disengaged from another retaining wall 343 when the release 32 is in the released position. When the release 32 is in the released position, the surface of the first stop tab 321 is retained on the retaining wall 341 and the second stop tab 322 is positioned at a second distance, which is smaller than the first distance, from the retainer 34 and is disengaged from the first block surface 211. The first biasing member 33 is compressed when the release 32 is moved from the retaining position to the released position.

When the retainer 34 is in the second position, the second stop tab 322 is retained within the cavity 342. When the retainer 34 is in the first position, the second stop tab 322 is positioned outside the cavity 342.

A pushing component 318 has a first pushing end 3181 connected to the igniter 21 and a second pushing end 3182 connected to the fuel container 22. The pushing component 318 is coupled to the actuator 31.

A lock 36 is movably coupled to the casing 20. The interior of the casing 20 includes a second channel 24 and the lock 36 is movably positioned in the second channel 24. The actuator 31 is selectively held in the actuated position by the lock 36. The lock 36 can continuously hold the actuator 31 in the actuated position. The actuator 31 and the lock 36 respectively have a first engaging component 3162 and a second engaging component 361. The first engaging component 3162 is engaged with the second engaging component 361 when the actuator 31 is held in the actuated position. The lock 36 is operably movable to a position such that the second engaging component 361 disengages from the first engaging component 3162. When the second engaging component 361 disengages from the first engaging component, 3162, the actuator 31 is then movable to the unactuated position.

The first engaging component 3162 is in a form of a protrusion. The first engaging component 3162 also has a protrusion serving as a stop. When the actuator 31 is held in the actuated position, the protrusion of the second engaging component 361 stops the protrusion of the first engaging component 3162 to prevent the actuator 31 moving from the actuated position to the unactuated position.

In view of the foregoing, the safety control device 30 prevents the blow torch 10 being actuated inadvertently in a fashion that is safe to users. In addition, the actuator 31 can be held in the actuated position by the lock 36.

The foregoing is merely illustrative of the principles of this invention, and various modifications can be made by those skilled in the art without departing from the scope and spirit of the invention.

What is claimed is:

1. A safety control device of a blow torch comprising:

an actuator;

a release movably coupled to the actuator, wherein the release is operably movable from a retaining position such that the actuator is retained to a released position such that the actuator is adapted to be operably moved, wherein the release has a first stop tab and a second stop tab protruding from the first stop tab;

a first biasing member positioned between the actuator and the release, wherein the release is urged by the first biasing member; and a second biasing member positioned between the actuator and a retainer, wherein the retainer is urged by the second biasing member, wherein the retainer has a retaining wall, and wherein the retaining wall has a cavity for retaining the second stop tab;

wherein when the release is in the retaining position, a surface of the first stop tab where the second stop tab protrudes is disengaged from the retaining wall, the second stop tab is positioned at a first distance from the retainer and outside the cavity, and the retainer is positioned in a first position; and wherein when the release is in the released position, the surface of the first stop tab is retained on the retaining wall, the second stop tab is positioned at a second distance, which is smaller than the first distance, from the retainer, the second stop tab is retained within the cavity, and the retainer is shifted from the first position to a second position.

2. The safety control device as claimed in claim 1, wherein the retainer has another retaining wall for retaining the first stop tab, wherein the first stop tab has a back surface retained on another retaining wall when the release is in the retaining position, and wherein the back surface is disengaged from another retaining wall when the release is in the released position.

3. The safety control device as claimed in claim 1, wherein the first and second stop tabs have different widths, and wherein the second stop tab has a smaller width than the first stop tab.

4. The safety control device as claimed in claim 3, wherein another retaining wall is contiguous to the retaining wall.

5. The safety control device as claimed in claim 4, wherein the retainer has a through hole and the release extends through the through hole, and wherein the cavity is contiguous with the through hole.

6. The safety control device as claimed in claim 1, wherein the actuator includes a guide track and the release is movably coupled to the guide track such that the release moves on the guide track when it changes between the retaining and the released positions.

7. The safety control device as claimed in claim 6, wherein the retainer has opposite first and second sides positioned on opposite first and second sides of the actuator.

8. The safety control device as claimed in claim 7, wherein the actuator has a first lug extending from the first side and a second lug extending from the second side respectively, wherein the retainer has a third lug extending from the first side and a fourth lug extending from the second side respectively, and wherein the first lug is movably coupled to the third lug and the second lug is movably coupled to the fourth lug respectively.

9. A blow torch comprising:

a casing having an interior with a first block surface;

an igniter received within the interior; and a safety control device movably coupled to the casing and connected to the igniter;

wherein the safety control device including:

an actuator movably coupled to the casing, wherein the actuator is operably movable from an unactuated position to an actuated position;

a release movably coupled to the actuator, wherein the release is operably movable from a retaining position for retaining the actuator in the unactuated position to a released position such that the actuator is adapted to be operably moved from the unactuated position to the actuated position, wherein the release has a first stop tab and a second stop tab protruding from the first stop tab;

a first biasing member positioned between the actuator and the release, wherein the release is urged by the first biasing member;

a retainer movably coupled to the actuator and having a retaining wall, wherein the retainer is positioned in a first position when the release is in the retaining position and is shifted to a second position when the release is operably moved from the retaining position to the released position; and a second biasing member positioned between the actuator and a retainer, wherein the retainer is urged by the second biasing member, wherein the retainer has a retaining wall, and wherein the retaining wall has a cavity for retaining the second stop tab;

wherein when the release is in the retaining position, a surface of the first stop tab where the second stop tab protrudes is disengaged from the retaining wall, the second stop tab is positioned at a first distance from the retainer and outside the cavity and retained on the first block surface, and the retainer is positioned in a first position; and wherein when the release is in the released position, the surface of the first stop tab is retained on the retaining wall, second stop tab is positioned at a second distance, which is smaller than the first distance, from the retainer, the second stop tab is retained within the cavity and is disengaged from the first block surface, and the retainer is shifted from the first position to a second position.

10. The blow torch as claimed in claim 9, wherein the retainer has another retaining wall for retaining the first stop tab, wherein the first stop tab has a back surface retained on another retaining wall when the release is in the retaining position, and wherein the back surface is disengaged from another retaining wall when the release is in the released position.

11. The blow torch as claimed in claim 9, wherein the retainer has a third stop tab and the interior of the casing has a second block surface for retaining the third stop tab, wherein the retainer is disengaged from the second block surface when the actuator is in the unactuated position, and wherein the third stop tab is retained on the second block surface when the actuator is moved to a position between the unactuated position and the actuated position.

12. The blow torch as claimed in claim 9, wherein the igniter is fluidly connected to a fuel container and the safety control device includes a pushing component with a first pushing end connected to the igniter and a second pushing end connected to the fuel container, and wherein the pushing component is coupled to the actuator.

13. The blow torch as claimed in claim 9 further comprising a lock movably coupled to the casing, and wherein the actuator is selectively held in the actuated position by the lock.

* * * * *